US010532903B2

(12) United States Patent
Haag et al.

(10) Patent No.: US 10,532,903 B2
(45) Date of Patent: Jan. 14, 2020

(54) WINDING DEVICE FOR WEB-SHAPED MATERIAL AND METHOD FOR DRAWING AT LEAST ONE MATERIAL WEB INTO AT LEAST ONE WINDING DEVICE

(71) Applicant: KOENIG & BAUER AG, Würzburg (DE)

(72) Inventors: Thorsten Haag, Oberpleichfeld (DE); Uwe Rambacher, Würzburg (DE); Walter Ritter, Grünsfeld (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/766,014

(22) PCT Filed: Nov. 4, 2016

(86) PCT No.: PCT/EP2016/076672
§ 371 (c)(1),
(2) Date: Aug. 7, 2018

(87) PCT Pub. No.: WO2017/080922
PCT Pub. Date: May 18, 2017

(65) Prior Publication Data

US 2018/0362282 A1 Dec. 20, 2018

(30) Foreign Application Priority Data

Nov. 9, 2015 (DE) ..... 10 2015 221 919

(51) Int. Cl.
*B65H 19/22* (2006.01)
*B65H 19/28* (2006.01)
*B65H 23/04* (2006.01)

(52) U.S. Cl.
CPC ..... *B65H 19/2223* (2013.01); *B65H 19/28* (2013.01); *B65H 23/04* (2013.01);
(Continued)

(58) Field of Classification Search
CPC .... B65H 19/2223; B65H 23/04; B65H 19/28; B65H 2402/32; B65H 2301/522; B65H 2403/942; B65H 20/06; B41F 13/03
See application file for complete search history.

(56) References Cited

U.S. PATENT DOCUMENTS 5,263,414 A 11/1993 Lehrrieder et al.
5,273,222 A * 12/1993 Hutzenlaub ..... B65H 18/26 242/527
(Continued)

FOREIGN PATENT DOCUMENTS

DE 3600517 A1 7/1987
DE 19707427 A1 8/1998
(Continued)

*Primary Examiner* — William A. Rivera
(74) *Attorney, Agent, or Firm* — Mattingly & Malur, PC

(57) ABSTRACT

A winding device for a web-shaped material has at least one first frame and at least one first roller holding device, with at least one roller holding assembly which can rotate about a first rotational axis. The winding has device at least one pressing element, and the at least one pressing element is arranged to be movable relative to the first frame in at least one adjustment direction and opposite that at least one adjustment direction. The at least one adjustment direction has at least one component which points towards the first rotational axis. A guide system for at least one drawing device, for drawing at least one material web, is arranged such that a first guide section of the guide system is arranged in a stationary manner relative to the at least one first frame. At least one linear connection between the at least one pressing element and the first rotational axis always intersects a second guide section of the guide system, regardless of the position of the at least one pressing element. A method for drawing a material web into a winding device is also provided.

13 Claims, 5 Drawing Sheets

(52) U.S. Cl.
CPC .... *B65H 2301/522* (2013.01); *B65H 2402/32* (2013.01); *B65H 2403/942* (2013.01)

(56) References Cited

U.S. PATENT DOCUMENTS

| | | | | |
|---|---|---|---|---|
| 5,390,875 | A * | 2/1995 | Gietman, Jr. | B65H 19/267 242/521 |
| 6,308,908 | B1 | 10/2001 | Marchante | |
| 6,398,153 | B1 * | 6/2002 | Karaki | G03B 17/26 242/523.1 |
| 7,661,622 | B2 * | 2/2010 | Hada | B65H 18/22 242/535.4 |
| 7,922,642 | B2 | 4/2011 | Beck et al. | |
| 8,162,251 | B2 * | 4/2012 | Vaughn | B65H 18/22 242/535.4 |
| 8,459,586 | B2 * | 6/2013 | Vaughn | B65H 19/2207 242/533.3 |
| 8,800,908 | B2 * | 8/2014 | McNeil | B65H 18/26 242/533.4 |
| 2003/0122025 | A1 * | 7/2003 | Suzuki | G03B 17/26 242/533.4 |
| 2007/0163699 | A1 | 7/2007 | Wellenhofer et al. | |

FOREIGN PATENT DOCUMENTS

| | | | |
|---|---|---|---|
| DE | 102014201674 | A1 | 4/2015 |
| DE | 102014003159 | A1 | 9/2015 |
| EP | 553740 | A1 | 1/1993 |
| EP | 1930163 | A2 | 6/2008 |

* cited by examiner

WINDING DEVICE FOR WEB-SHAPED MATERIAL AND METHOD FOR DRAWING AT LEAST ONE MATERIAL WEB INTO AT LEAST ONE WINDING DEVICE

CROSS REFERENCE TO RELATED APPLICATIONS

This application is the U.S. National Phase, under 35 U.S.C. § 371, of PCT/EP2016/076672, filed Nov. 4, 2016; published as WO2017/080922A1 on May 18, 2017 and claiming priority to DE 10 2015 221 919.4, filed Nov. 9, 2015, the disclosures of which are expressly incorporated herein by reference in their entireties.

FIELD OF THE INVENTION

The present invention relates to a winding device for web-shaped material and to a method for drawing at least one material web into at least one winding device.

BACKGROUND OF THE INVENTION

In machines for processing web-type material, for example in web-fed printing machines, webbing-up means are frequently used to facilitate the threading of a material web into the processing machine. For example, webbing-up means embodied as web-up chains are used, which are routed in corresponding guides. These guides are open toward at least one side, so that a connecting element can be connected to both the webbing-up means and the material web. The driven movement of the webbing-up means then also moves the leading end of the material web, threading it as far as possible through the processing machine.

Winding devices are also used in machines for processing web-type material. Typically, a throw-on roller is provided, the position of which is variable. This ensures that for any thickness of the wound material roll, the desired contact pressure of the incoming material against said material roll can be achieved.

A winding device is known from DE 3600517 A1.

A system for guiding a webbing-up means is known from EP 553740 A1.

A device for threading a material web into a folding apparatus is known from EP 1930163 A2.

SUMMARY OF THE INVENTION

The object of the present invention is to devise a winding device for web-shaped material and a method for drawing at least one material web into at least one winding device.

The object is achieved according to the invention by the provision a winding device for web-type material. The winding device has at least one first frame and at least one first roll holding device having at least one roll holding assembly that is rotatable about a first rotational axis. The winding device has at least one throw-on element which is disposed moveably relative to the first frame in one of at least one adjustment direction and in a direction opposite the at least adjustment direction. This at least one adjustment direction has at least one component that points towards the first rotational axis. A guidance system for at least one webbing-up assembly, for webbing-up at least one material web, is disposed such that a first guidance section of the guidance system is disposed fixedly relative to the at least one first frame. Regardless of the position of the at least one throw-on element, at least one rectilinear connection between the at least one throw-on element and the first rotational axis always intersects a second guidance section of the guidance system. A method for threading at least one material web into at least one winding device utilizes a webbing-up assembly which is movable along at least one first guidance section, thereby moving a material web. The webbing-up assembly is guided at an inlet into a second guidance section and, after at least partially passing through the second guidance section, is halted. The material web is then separated from the webbing-up assembly and is attached to one of a core and a material roll. The second guidance section is then moved relative to the first guidance section, and together with this movement, at least one throw-on element is moved up to a material roll of the winding device. The material web is at least subsequently wound onto the material roll.

The advantages to be achieved by the invention consist, in particular, in that a material web can be threaded in, even along web paths that can be varied by displacing web lead elements that are involved in said paths.

In this way, effort that would otherwise be required of machine operators can be reduced. In particular, the effort of manually threading the material web around a series of movable rollers and attaching it to a core is avoided. The throw-on function nevertheless remains unimpaired.

BRIEF DESCRIPTION OF THE DRAWINGS

An exemplary embodiment of the invention is illustrated in the set of drawings and will be described in greater detail below.

The drawings show.

DESCRIPTION OF THE PREFERRED EMBODIMENT

Figure 1:
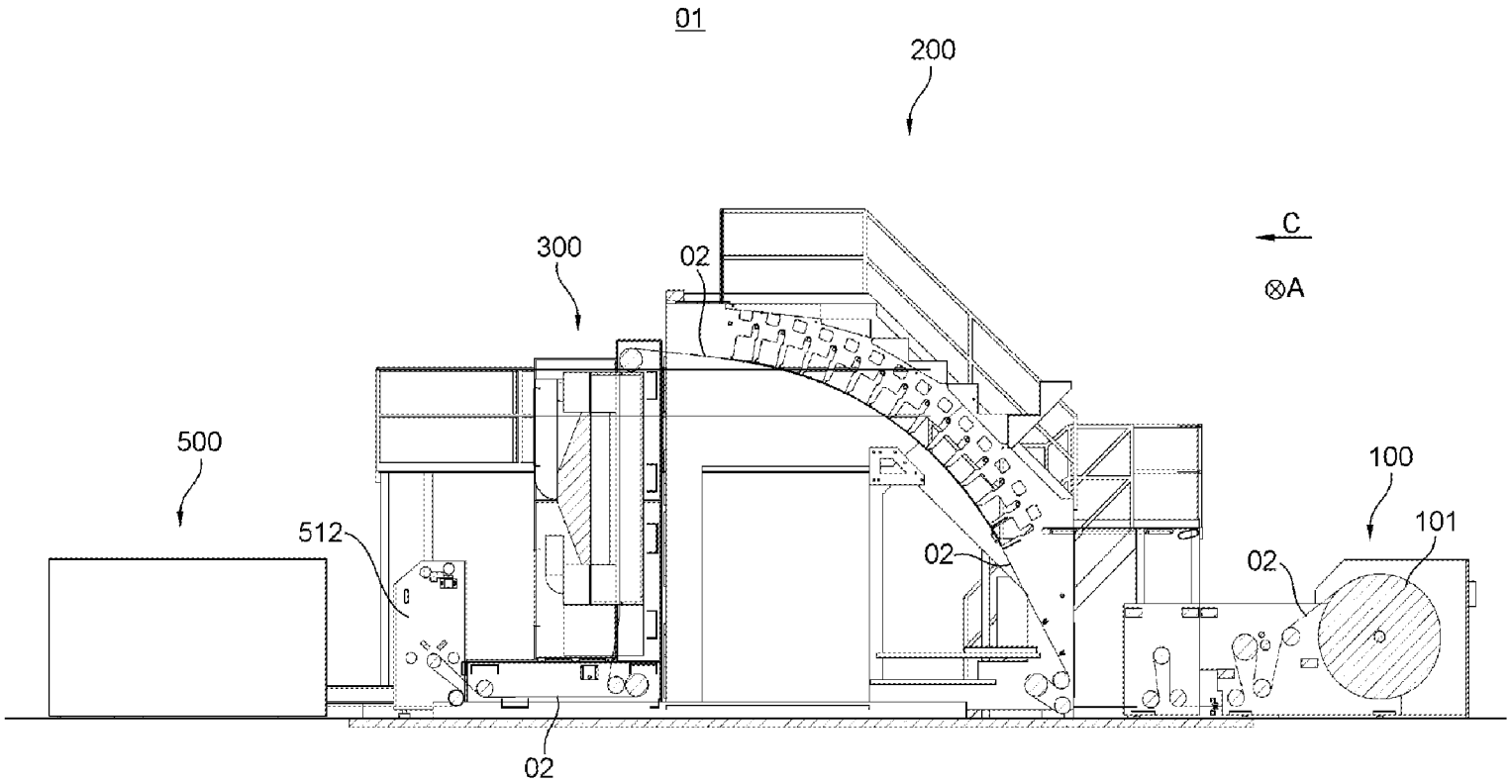
FIG. 1 a diagram of a processing machine embodied as a printing machine and having at least one winding device.
Figure 2A:
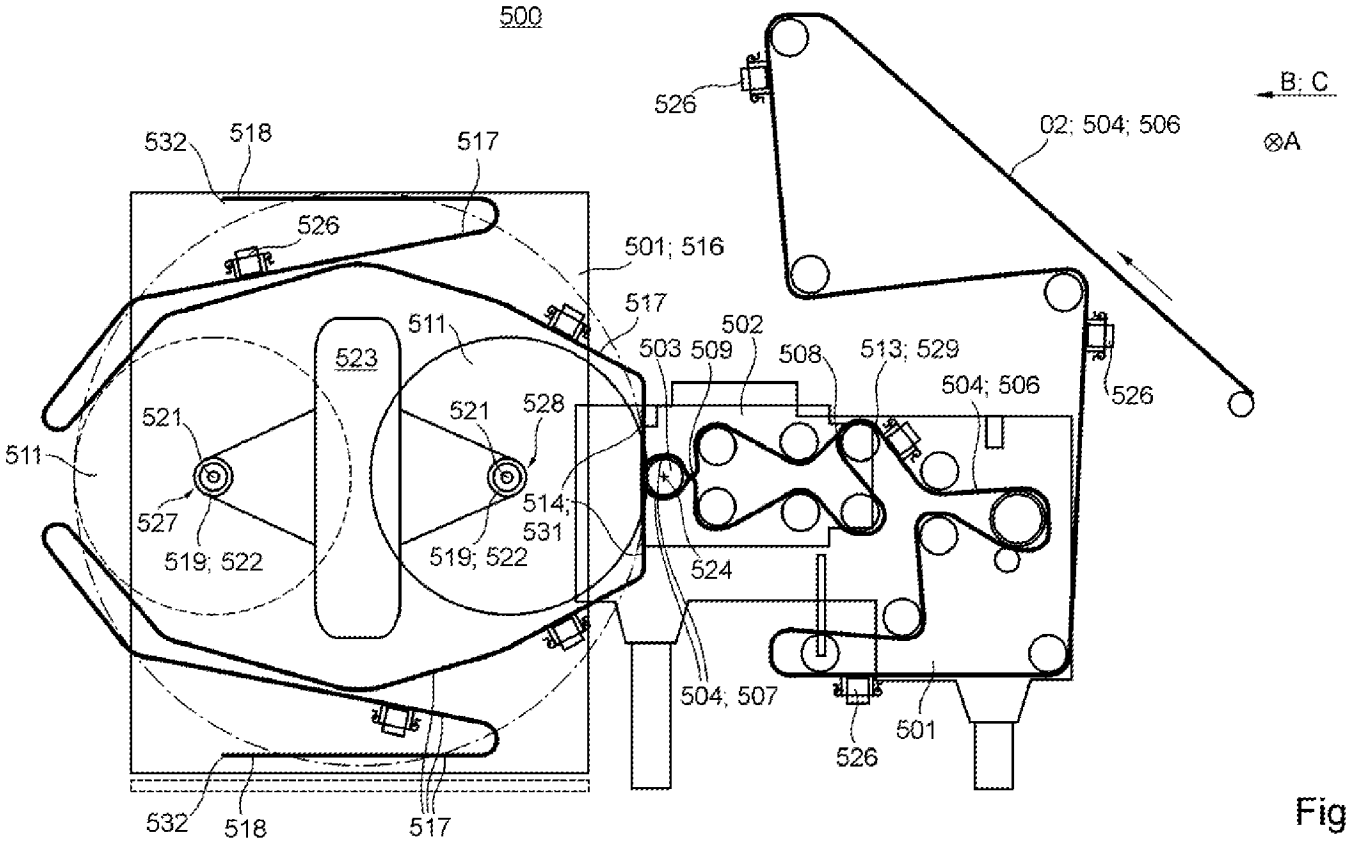
FIG. 2*a* a diagram of a winding device including a web-up system and a material roll having a first diameter, in which a second guidance section is disposed in a web advancing position.
Figure 2B:
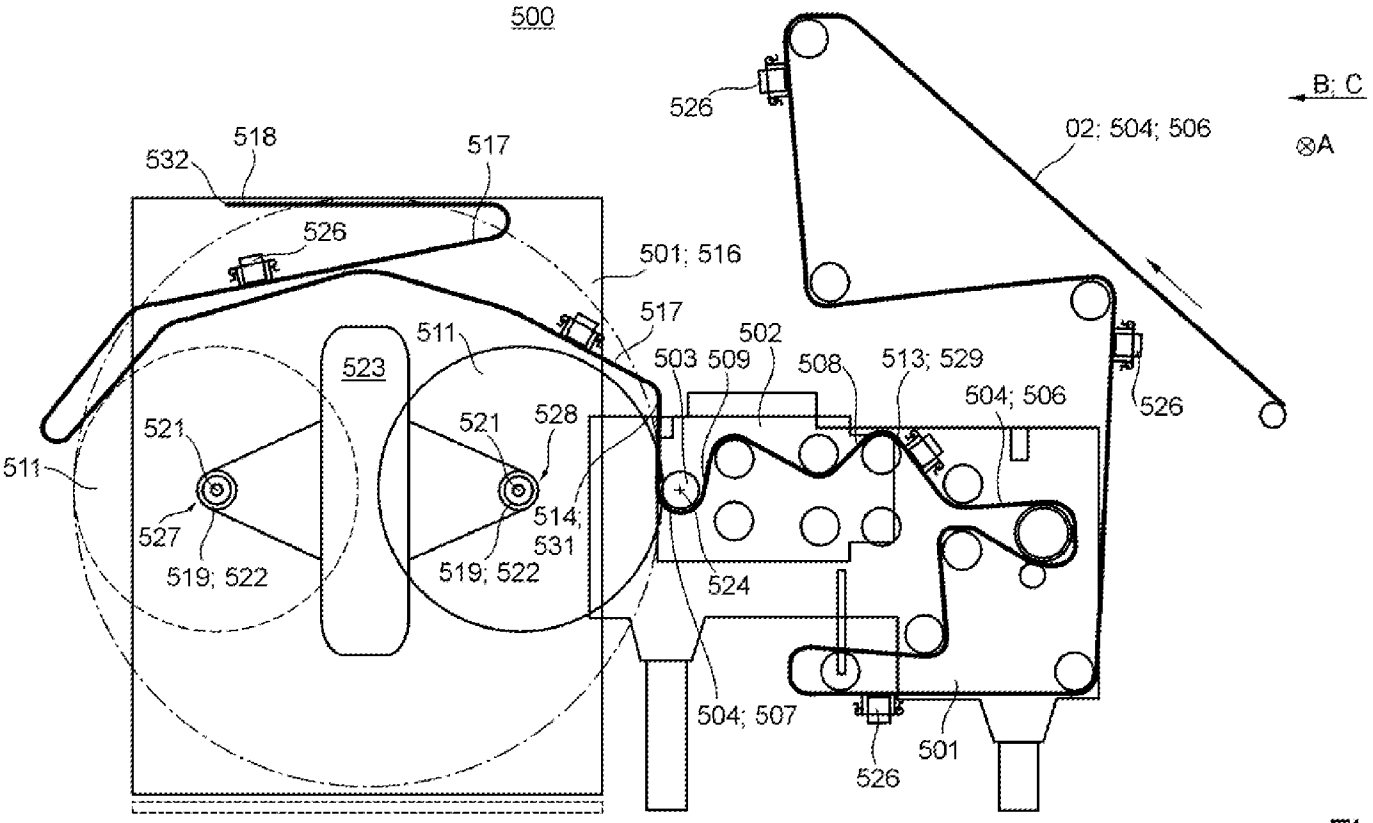
FIG. 2*b* a diagram according to FIG. 2*a*, in which for the sake of clarity, only the parts of a guidance system that correspond to a first webbing-up path are shown, while the parts of the guidance system that correspond to a second webbing-up path are hidden.
Figure 2C:
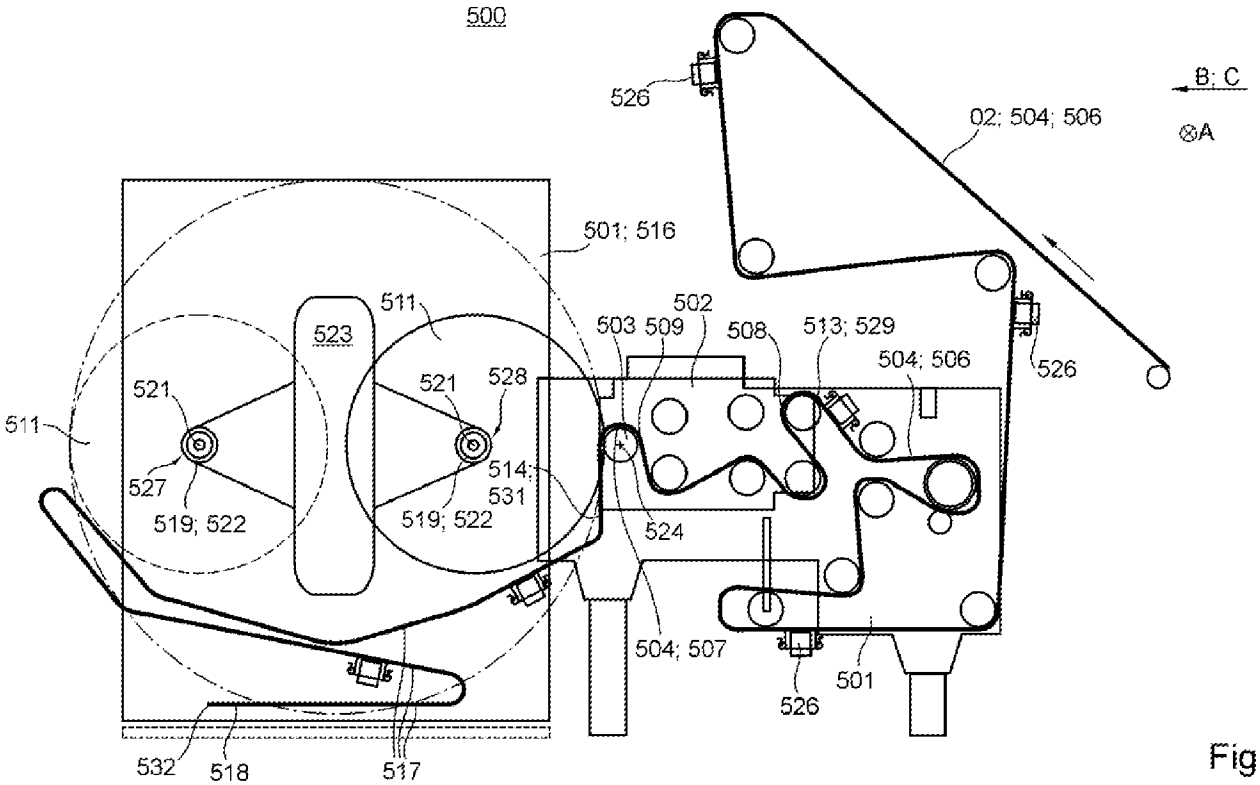
FIG. 2*c* a diagram according to FIG. 2*a*, in which for the sake of clarity, only the parts of a guidance system that correspond to the second webbing-up path are shown, while the parts of the guidance system that correspond to the first webbing-up path are hidden.
Figure 3:
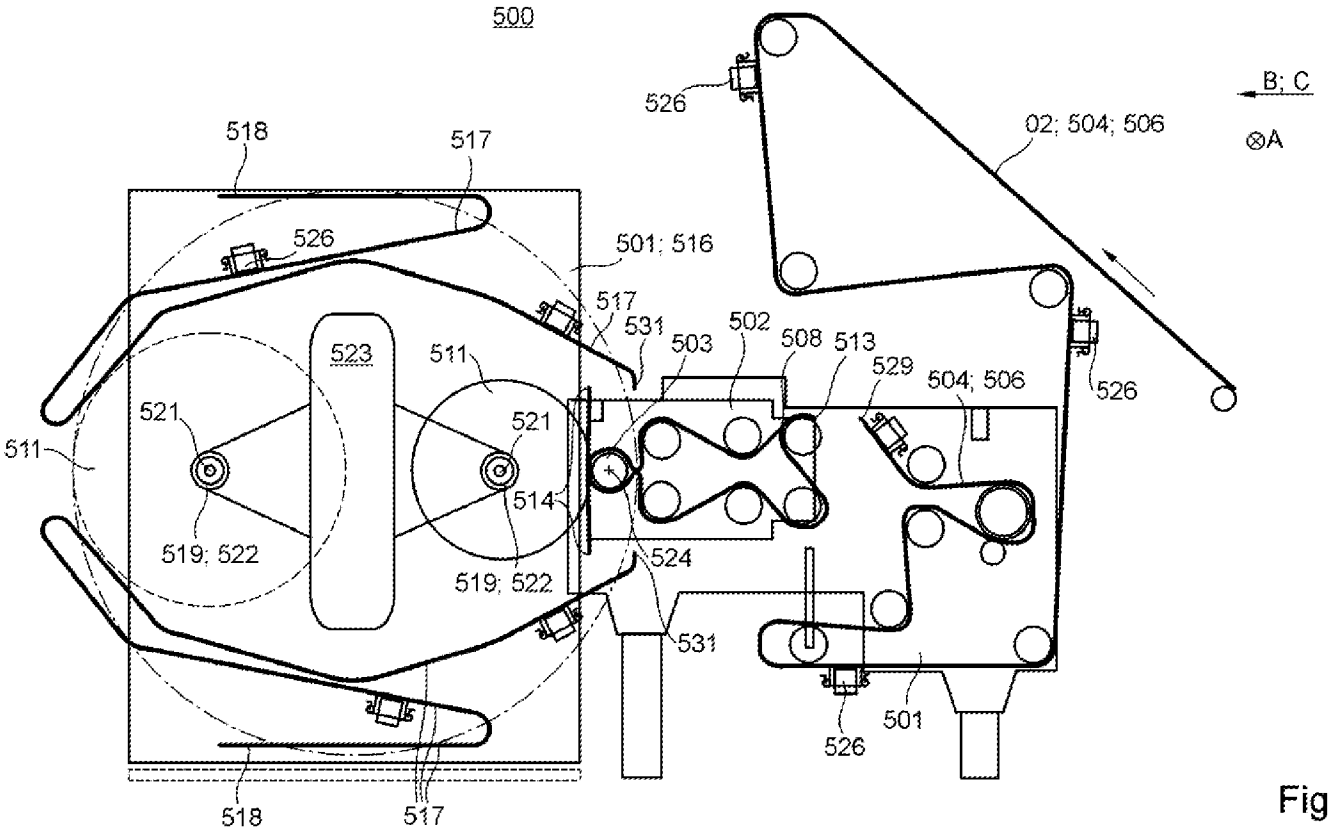
FIG. 3 a diagram of a winding device including a web-up system and a material roll having a second diameter, in which a second guidance section is disposed in an offset position.

A processing machine 01 is embodied, for example, as at least one printing machine 01 and/or coating machine 01 and/or laminating machine 01 and/or punching machine 01 and/or embossing machine 01 and/or folding machine 01. Processing machine 01 is preferably used for processing web-type material, i.e. a material web 02 or a plurality of material webs 02, for example. The web-type material may be a web-type printing substrate, for example, i.e. a printing substrate web 02. Processing machine 01 includes at least one material source 100, for example, preferably embodied as web source 100 and optionally as printing substrate source 100. This material source 100 is preferably a roll unwinding device 100 and is embodied, for example, as at least one roll changer 100 having a plurality of roll holding devices 519. At least one material roll 101 to be unwound, preferably embodied as at least one roll of printing substrate 101 to be unwound, for example, is located in material source 100.

Processing machine 01 includes at least one processing unit 200. If the processing machine is a printing machine 01, said printing machine 01 includes at least one processing unit 200 embodied as a printing unit 200, for example. Said at least one printing unit 200 preferably operates by a known printing method, for example offset printing, letterpress printing, planographic printing, gravure printing, screen printing, inkjet printing, electrophotography, xerography, or the like. Processing machine 01 includes at least one dryer unit 300, for example, which is used for drying the material web 02 that has been treated, for example, in the at least one processing unit 200 embodied, in particular, as printing unit 200. Processing machine 01 includes at least one inspection device 512, for example, which is used for inspecting the material web 02 once it has been processed. Processing machine 01 includes at least one winding device 500, for example. The at least one winding device 500 is preferably used for winding up a material web 02 that has been processed, for example a printing substrate web 02 that has been printed. In said process, material web 02 is preferably wound up onto a material roll 511 to be wound. To accomplish this, material web 02 is first attached to a core, for example, the rotation of which produces wound material roll 511. Winding device 500 is preferably a part of processing machine 01, and processing machine 01 is preferably embodied as at least one printing machine 01 and/or coating machine 01 and/or laminating machine 01.

Processing machine 01 preferably includes a system for threading at least one material web 02 into and/or through processing machine 01. This system preferably comprises a guidance system 504 for at least one webbing-up means. The at least one webbing-up means is used in particular for webbing up at least one material web 02. By means of guidance system 504, the material web 02, in particular the leading end thereof, can preferably be threaded at least through the at least one processing unit 200, in particular printing unit 200, and into winding device 500. More preferably, by means of guidance system 504, the material web 02 can be threaded from material source 100 through at least one infeed unit and/or through the at least one processing unit 200, preferably embodied as printing unit 200, and/or through the at least one dryer unit 300, and/or through the at least one inspection device 512, and/or into the at least one winding device 500. Preferably, at least one webbing-up means that is movable along at least one webbing-up path for webbing up a material web 02, in particular printing substrate web 02, and/or at least one webbing-up means that is movable along at least one transport path intended for material web 02, in particular printing substrate web 02, for webbing up a material web 02, in particular printing substrate web 02, is and/or can be arranged, at least temporarily, at least within the at least one processing unit 200, in particular printing unit 200, and more preferably in additional areas of processing machine 01, in particular printing machine 01. Processing unit 200 is different, in particular, from winding device 500.

Preferably, at least portions of the at least one webbing-up path, more preferably at least the portion of the webbing-up path that is located within processing unit 200, is/are spaced by a distance of at least 2 cm, more preferably at least 4 cm, even more preferably at least 6 cm, and more preferably still at least 8 cm in a transverse direction A or axial direction A from every target area of every processing tool of the at least one first processing unit 200. Preferably, at least parts of the webbing-up means, and more preferably at least the part of the webbing-up means that is located within processing unit 200, is/are spaced by a distance of at least 2 cm, more preferably at least 4 cm, even more preferably at least 6 cm, and more preferably still at least 8 cm in the transverse direction A from every target area of every processing tool of the at least one first processing unit 200. In particular, the at least one webbing-up path and/or the at least one webbing-up means is preferably located outside of the working width of printing machine 01 with respect to axial direction A. At least one material web 02 preferably is and/or can be connected via at least one connecting element, more preferably embodied as at least one web-up kite, to the at least one webbing-up means, in particular regardless of whether the at least one webbing-up means is embodied as a web-up belt and/or a web-up chain and/or as a finite webbing-up means. The webbing-up means is preferably different from any material to be processed.

If processing machine 200 is embodied as a printing machine 200, at least parts of the at least one webbing-up path, more preferably at least the part of the webbing-up path that is located within printing unit 200, is/are preferably spaced by a distance of at least 2 cm, more preferably at least 4 cm, even more preferably at least 6 cm, and more preferably still at least 8 cm in a transverse direction A or axial direction A from every target area of every nozzle of every print head 221 of the at least one first printing unit 200. In that case, preferably at least parts of the webbing-up means, and more preferably at least the part of the webbing-up means that is located within printing unit 200, is/are spaced by a distance of at least 2 cm, more preferably at least 4 cm, even more preferably at least 6 cm, and more preferably still at least 8 cm in the transverse direction A from every target area of every nozzle of every print head 221 of the at least one first printing unit 200. The at least one webbing-up path and/or the at least one webbing-up means is preferably located, in particular, outside of the working width of printing machine 01 with respect to axial direction A. In that case, at least one printing substrate web 02 preferably is and/or can be connected via at least one connecting element, more preferably embodied as at least one web-up kite, to the at least one webbing-up means, in particular regardless of whether the at least one webbing-up means is embodied as a web-up belt and/or a web-up chain and/or as a finite webbing-up means. The webbing-up means is preferably different from any printing substrate 02.

The at least one webbing-up means is preferably embodied as at least one finite webbing-up means, for example as a finite web-up belt and/or preferably as a finite web-up chain. At least one web-up drive 526 is preferably provided, by means of which the at least one webbing-up means can be movably arranged along the at least one webbing-up path. More preferably, a plurality of web-up drives 526 are arranged at appropriately selected intervals along the webbing-up path, to ensure that the at least one webbing-up means is always located within the zone of influence of at least one web-up drive 526. At least one web-up storage space 518 is preferably provided, in which the at least one webbing-up means can be located at least temporarily, in particular as long as it is not being used for threading in a material web 02. For example, at least one web-up storage space 518 is located at each end 532 of the at least one webbing-up path. The at least one webbing-up means is embodied as at least one finite web-up chain, for example. The at least one webbing-up means preferably has idler rollers, in particular for achieving the least possible resistance within guidance system 504.

Guidance system 504 preferably has a plurality of guidance sections 506; 507; 517, by means of which at least one webbing-up path of the at least one webbing-up means can be and/or is defined. For example, guidance system 504 includes a plurality of rail sections 506; 507; 517. In particular, guidance sections 506; 507; 517 are preferably embodied as rail sections 506; 507; 517. At least part of the at least one web-up lead element is preferably embodied as a diverter 508 and/or as an intersection 509. This enables complex guidance paths to be achieved. A guidance section 506; 507; 517 is generally a section of guidance system 504 that holds the webbing-up means on its intended webbing-up path while the webbing-up means is moving and/or while it is idle.

The at least one winding device 500 preferably has at least one first frame 501 and at
least one first subframe 502 that is movable relative thereto. The at least one first frame 501 is preferably the main frame 501 of the winding device 500 in question. The at least one subframe 502 is preferably a throw-on carriage 502, for example. The at least one movable subframe 502 and the at least one throw-on element 503 preferably connected thereto ensure, for example, the proper winding of material web 02 onto the material roll 511 to be wound. The at least one winding device 500 preferably has at least one roll holding device 519, which in turn has at least one roll holding means 522 that is rotatable about a first rotational axis 521. Wherever rotational axes 521; 524 are mentioned above and/or in the following, these are understood as rotational axes 521; 524 in the mathematical sense, i.e. in particular, straight lines extending to infinity, which may partially, but do not necessarily coincide with actual components of winding device 500. A roll holding means 522 is, for example, a holding cone 522 and/or clamping cone 522 and/or a roll holding shaft 522 and/or clamping shaft 522, in particular having driver elements that are adjustable in terms of their position relative to roll holding means 522. The at least one roll holding means 522 is preferably a component of the at least one roll holding device 519. The at least one roll holding device 519 has a pair of roll holding means 522, for example, and/or at least one roll driving motor. Winding device 500 is embodied as a turret winder 500, for example. In that case, winding device 500 has a plurality of roll holding devices 519, i.e. in particular at least two.

For placing a material roll 511 on the rotational axis or removing it therefrom, for example, the at least one roll holding device 519 is preferably movable in such a way that its first axis of rotation 521 can be displaced, in particular pivoted about a first pivot axis 523, in particular relative to first frame 501 and/or subframe 502. In the case of a turret winder 500, all of roll holding devices 519 are preferably collectively displaceable,
in particular pivotable about a common first pivot axis 523.

A turret winder 500 enables a continuous winding of material web 02 as the processing of material web 02 proceeds within processing machine 01, even after a material roll 511 has reached its maximum allowable or desired diameter. For this purpose, the material roll 511 that has already been wound is moved, along with the roll holding means 522 that support said roll, out of its winding position 528. During this movement, the running material web 02 preferably comes into contact with a core located on another roll holding means 522 and is held there by means of gluing, for example. At least roughly simultaneously, the material web 02 is severed, producing two subsections, specifically the subsection now adhering to the new core and the subsection that has already largely been wound onto the material roll 511. The subsection now glued to the core is wound onto this core by rotation of said core, forming a new material roll 511 to be wound up. While the new core, and thus this new material roll 511 to be wound, is shifted into the winding position 528 by movement of the roll holding means 522, the already wound material roll 511 is moved, preferably simultaneously, to a change-out position, in which an operator is able to access this wound material roll 02.

At least one web lead element 503, embodied as throw-on element 503, is preferably situated as movable relative to the first frame 501 in a direction having at least one component that points toward the first rotational axis 521 and/or in at least one direction having at least one component that points away from the first rotational axis 521. An adjustment direction B is preferably a direction having at least one component that points toward the first rotational axis 521. For example, adjustment direction B is a radial direction with respect to the first rotational axis 521. More particularly, the at least one throw-on element 503 is preferably situated as movable, displacing its center of gravity.

Preferably, the at least one web lead element 503 embodied as throw-on element 503 is situated as movable relative to the first frame 501 in and/or opposite the adjustment direction B. Adjustment direction B is preferably oriented orthogonally to transverse direction A. Adjustment direction B is preferably oriented horizontally and/or deviates from a horizontal direction by at most 30°, and more preferably by at most 15°. Transverse direction A is preferably oriented parallel to the first rotational axis 521 of roll holding means 522 and/or parallel to the first pivot axis 523 and/or to a second rotational axis 524 of a rotatable throw-on element 503.

The at least one throw-on element 503 serves, for example, to throw material web 02 onto material roll 511 in winding device 500 and thus to ensure a clean winding of material web 02 onto material roll 511, in particular printing substrate roll 511. This material roll 511 contains, in particular, material that has already been processed in processing machine 01. The at least one throw-on element 503 is preferably embodied as at least one throw-on element 503 that is rotatable about a second rotational axis 524, in particular as at least one throw-on roller 503 that is rotatable about the second rotational axis 524. The at least one throw-on element 503 can preferably be moved toward the first rotational axis 521 and/or away from the first rotational axis 521, thereby enabling contact at all times between material roll 02 and throw-on element 503, with appropriate contact pressure force based upon the current diameter of the material roll 511 onto which the material web 02 is being wound. Preferably, the at least one throw-on element 503 is disposed such that it is movable jointly with the at least one subframe 502. More particularly, therefore, the second rotational axis 524 of the at least one throw-on element 503 is situated as movable toward the first rotational axis 521 and/or away from the first rotational axis 521, in particular in and/or opposite the adjustment direction B, relative to the first frame 501.

At the start of a winding operation for winding a material web 02 onto a material roll 511, the leading end of this material web 02 must be attached to a core. For this purpose, this leading end of material web 02 must be brought into the area of said core and attached thereto. This attachment may be carried out manually, for example. If a webbing-up means is used for threading the material web 02 into winding device 500, material web 02 must first be separated from the webbing-up means. This separation is carried out manually, for example. guidance system 504 preferably extends into winding device 500. More preferably, guidance system 504 enables the leading end of material web 02 to be brought closer to a machine operator than the first rotational axis 521 of the at least one roll holding means 522 in its position closest to the machine operator. This position is an access position 527, for example, in which the machine operator has access to the material roll 511 that will be or has been wound, or to the core thereof. If winding device 500 is embodied as a turret winder, in particular, access position 527 is preferably a different position from winding position 528. Winding position 528 is the position the roll holding means 522 and/or the core and/or the material roll 511 is in when material is to be wound onto this core and/or material roll 511. Roll holding means 522, and any cores and/or material rolls 511 that are attached thereto, are preferably situated as movable, in particular pivotable, between winding position 528 and access position 527.

In that case, winding position 528 is located, for example, between access position 527 and the at least one throw-on element 503, with respect to a longitudinal direction C. This longitudinal direction C is oriented orthogonally to the first rotational axis 521 and at the same time is oriented horizontally. Longitudinal direction C and adjustment direction B are preferably oriented parallel to one another. With this arrangement, once the core onto which material has just been wound has been changed out, a full material roll 511 can be removed and/or a new empty core can be inserted for subsequent winding operations. However, since this makes it harder for machine operators to access winding position 528, a guidance section 517 of guidance system 504 is preferably arranged such that it can transport the webbing-up means, and thus also material web 02, around winding position 528 and more preferably also at least partially around access position 527, up to a point where a machine operator can easily access the material web 02. This guidance section 517 is preferably a third guidance section 517. Along the webbing-up path, in particular substantially parallel to a direction of transport of material web 02, preferably at least one first guidance section 506 is located, followed by at least one second guidance section 507. Further preferably, the at least one third guidance section 517 is located downstream of these.

Preferably, winding device 500 is thus alternatively or additionally characterized in that when a roll holding means 522 is located in its winding position 528, the first rotational axis 521 of said roll holding means 522 is located between the at least one throw-on element 503 and at least a portion of the third guidance section 517 of guidance system 504, with respect to longitudinal direction C. In that case, it is not necessary for a rectilinear connection between throw-on element 503 and third guidance section 517 to intersect the first rotational axis 521 of the roll holding means 522 in question, when roll holding means 522 is in its winding position 528. The third guidance section 517 is preferably embodied such that at its end 532, it has a web-up storage space 518, i.e. a section in which the webbing-up means can be stored, at least temporarily. This is helpful particularly in the case of a long webbing-up means, for example a web-up chain, which may be several meters in length, and on which the connecting element and/or the material web 02 is attached, typically relatively centrally. When a machine operator wishes to access the area of the webbing-up means where this attachment is to be released, the area of the webbing-up means located in front of said area must be stowed. In principle, the webbing-up means may remain in the third guidance section
517 during winding, however it is preferably returned to the at least one first guidance section 517 prior to winding.

Since the guidance system 504 must also lead partially around movable components, in particular around the at least one throw-on element 503, for the proper functioning of winding device 500, at least one guidance section 507, in particular the at least one second guidance section 507, is preferably situated as movable. Particularly in the area of winding device 500, guidance system 504 therefore preferably has at least two guidance sections 506; 507; 517 that are movable relative to one another. guidance sections 506; 507; 517 are preferably embodied as rail sections 506; 507; 517. The first guidance section 506 of guidance system 504 is preferably disposed fixedly relative to the at least one first frame 501, and attached to the first frame 501, for example. It preferably serves to transport the webbing-up means coming from processing unit 200 and/or dryer unit 300 and/or inspection device 512 to winding device 500, and/or within a first area of winding device 500. The first guidance section 506 wraps around a series of draw rollers and/or dancer rollers, for example, which ensure in particular the proper tension and/or position of material web 02 in winding device 500, and which are referred to collectively as an infeed unit. The transport path intended for material web 02 subsequently wraps around a series of rollers that are arranged on the movable subframe 502. At least one of these rollers is preferably the at least one throw-on element 503. These rollers preferably ensure the uniform transport of material web 02 up to the lateral surface of said material roll 101, regardless of the current diameter of the material roll 511 that is being wound.

To support this transport path of material web 02, the webbing-up path for the webbing-up means is also arranged accordingly, wrapping around the same rollers and/or throw-on elements 503. At least one second guidance section 507 of guidance system 504 is preferably situated as movable, in particular relative to the first guidance section 506 and/or relative to the first frame 501. More preferably, the at least one second guidance section 507 of guidance system 504 is situated as movable together with the at least one subframe 502 and/or between at least one web advancing position and at least one offset position relative to the at least one first guidance section 506. The at least one second guidance section 507 preferably comprises the part of guidance system 504 that is movable jointly with the at least one throw-on element 503, in particular from the beginning 513 of said part to its end 514. For webbing up material web 02, the at least one second guidance section 507 of guidance system 504 is preferably disposed in its web advancing position. This position enables the continuous transport of the webbing-up means through the first guidance section 506 and the transfer thereof to the second guidance section 507 and enables the continuous transport of the webbing-up means through the second guidance section 506 and preferably the transfer thereof to the third guidance section 517. The leading end of material web 02, which is connected directly or via a connecting element to the webbing-up means, thereby reaches an area that is accessible to a machine operator and in which it can be attached to a core. The webbing-up means can then be transported back again. At least one sensor is preferably provided, which registers and/or monitors the position of the at least one subframe 502 and/or of the at least one second guidance section 507, in particular relative to the first frame 501.

The beginning 513 of the part of guidance system 504 that can be moved jointly with the at least one throw-on element 503 is preferably likewise the beginning 513 or inlet 513 of the second guidance section 407. The end 514 of the part of guidance system 504 that can be moved jointly with the at least one throw-on element 503 is preferably likewise the end 514 or the outlet 514 of the second guidance section 407. The third guidance section 517 preferably has a beginning 531 or inlet 531 and/or an end 532. This end 532 is preferably not an outlet, and instead has a web-up storage space 518. The first guidance section 506 preferably has a beginning or inlet and/or an end 529, preferably embodied as outlet 529. The beginning of the first guidance section 506 is not shown in the figures. Preferably, at least one web-up storage space is located at the beginning of the first guidance section 506.

The web advancing position is preferably the position of the second guidance section 507 in which the transport of the webbing-up means from the first guidance section 506 to the second guidance section 507 via the outlet 529 of the first guidance section 506 and the inlet 513 of the second guidance section 507 and/or vice versa is enabled, and/or the position of the second guidance section 507 in which the transport of the webbing-up means from the second guidance section 507 to the third guidance section 517 via the outlet 514 of the second guidance section 507 and the inlet 531 of the third guidance section 517 and/or vice versa is enabled. The at least one offset position is preferably the position of the second guidance section 507 in which the transport of the webbing-up means from the first guidance section 506 to the second guidance section 507 or vice versa is prevented, in particular by a gap in guidance system 504, and/or the position of the second guidance section 507 in which the transport of the webbing-up means from the second guidance section 507 to the third guidance section 517 or vice versa is prevented, in particular by a gap in guidance system 504.

In a subsequent operation, the core with the material web 02 attached thereto is then placed in a winding position 528, and the at least one throw-on element 503 is thrown onto said core. For this purpose, the at least one second guidance section 507 is moved relative to the first guidance section and/or relative to the third guidance section 517, and if necessary, the webbing-up path of the webbing-up means is interrupted. This is non-problematic, however, because in this situation the transport of the webbing-up means is not necessary. As the radius of material roll 511 increases, subframe 502 and/or the at least one throw-on element 503 are then moved away from the first rotational axis 521 of said material roll, with the second guidance section 507 moving back toward the first guidance section 506 and/or the third guidance section 517.

Regardless of the position of the at least one throw-on element 503, at least one rectilinear connection between the at least one, in particular rotatable throw-on element 503 and the first rotational axis 521 preferably always intersects a second guidance section 507 of guidance system 504. More preferably, regardless of the position of the at least one throw-on element 503, at least one rectilinear connection between the second rotational axis 524 of the at least one, in particular rotatable throw-on element 503 and the first rotational axis 521 of the at least one roll holding element 522 always intersects the second guidance section 507 of guidance system 504. In other words, the guidance system 504 for the at least one webbing-up means is preferably disposed such that, regardless of the position of the second rotational axis 524 and more preferably also regardless of the position of the first rotational axis 521, at least one guidance section 507 of guidance system 504 is always located between first rotational axis 521 and second rotational axis 524. It is thereby ensured that the transport path along which the material web is to be threaded into winding device 500 always runs between the at least one throw-on element 503 and the at least one material roll 511. A corresponding point of intersection may also lie outside of winding device 500, in particular in transverse direction A.

The result is a winding device 500 for web-type material, in particular for winding up web-type material, wherein winding device 500 includes at least one first frame 501 and at least one first roll holding device 519 having at least one roll holding means 522 that is rotatable about a first rotational axis 521, and wherein winding device 500 includes at least one throw-on element 503, in particular rotatable about the second rotational axis 524, in particular for throwing a material web 02 onto a material roll 511, and wherein the at least one throw-on element 503 is disposed movably relative to the first frame 501 in at least one adjustment direction B and/or opposite said at least one adjustment direction B, and wherein said at least one adjustment direction B has at least one component that points toward the first rotational axis 521. In addition, a guidance system 504 for at least one webbing-up means for webbing up at least one material web 02 is preferably arranged such that a first guidance section 506 of guidance system 504 is disposed fixedly relative to the at least one first frame 501, and regardless of the position of the at least one throw-on element 503, and preferably regardless of the position of the first rotational axis 521, in particular relative to the first frame 501, at least one rectilinear connection between the at least one throw-on element 503 and the first rotational axis 521 always intersects a second guidance section 507 of guidance system 504.

The at least one throw-on element 503 is preferably embodied as at least one throw-on element 503 that is rotatable about at least one second rotational axis 524 and/or as at least one throw-on roller 503. More preferably, the at least one throw-on element 503 serves to throw a material web 02 onto a material roll 511. The at least one web lead element 503, embodied in particular as throw-on element 503, extends in transverse direction A, preferably over a width that is equal to at least 80% of the maximum web width of material web 02 that can be processed by means of the at least one winding device 500 and/or by processing machine 01.

As described, winding device 500 preferably has at least one subframe 502 that is disposed movably relative to the at least one first frame 501. The at least one throw-on element 503 and/or the at least one second guidance section 507 is/are preferably located on the at least one subframe 502. More preferably, the at least one throw-on element 503 and/or the at least one second guidance section 507 is/are mounted on the at least one subframe 502 so as to be movable jointly with the at least one subframe 502.

Preferably, winding device 500 is alternatively or additionally characterized in that the at least one second guidance section 507 is disposed such that it is movable relative to the at least one first guidance section 506 between at least one web advancing position and at least one offset position. Further preferably, when the second guidance section 507 is in the offset position, the webbing-up path of the at least one webbing-up means is interrupted, in particular between the first guidance section 506 and the second guidance section 507, and/or when the second guidance section 507 is in the offset position, the webbing-up path of the at least one webbing-up means has at least one gap of at least 20 cm, more preferably at least 50 cm and even more preferably at least 75 cm. When the second guidance section 507 is in its offset position, an end 529 of the first guidance section 506, in particular with respect to the webbing-up path of the webbing-up means, and a beginning 513 of the second guidance section 507, in particular with respect to said webbing-up path, are preferably spaced at least 20 cm, more preferably at least 50 cm, and even more preferably at least 75 cm further from one another than when the second guidance section 507 is in its web advancing position. This distance is preferably measured in adjustment direction B and may be zero, in particular when the second guidance section 507 is in its web advancing position.

When the second guidance section 507 is in the offset position, the webbing-up path of the at least one webbing-up means is preferably interrupted, in particular between the second guidance section 507 and the third guidance section 517, and/or when the second guidance section 507 is in the offset position, the webbing-up path of the at least one webbing-up means preferably has at least two gaps of at least 20 cm, more preferably at least 50 cm, and even more preferably at least 75 cm. When the second guidance section 507 is in its offset position, an end 514 of the second guidance section 507, in particular with respect to the webbing-up path of the webbing-up means, and a beginning 531 of the third guidance section 517, in particular with respect to said webbing-up path, are preferably spaced at least 20 cm, more preferably at least 50 cm, and even more preferably at least 75 cm further from one another than when the second guidance section 507 is in its web advancing position. This distance is preferably measured in adjustment direction B and may be zero, in particular when the second guidance section 507 is in its web advancing position.

Therefore, when the second guidance section 507 is disposed in the offset position, transport of the webbing-up means between the first guidance section 506 and the second guidance section 507 is preferably not possible, and/or when the second guidance section 507 is in the offset position, transport of the webbing-up means between the second guidance section 507 and the third guidance section 517 preferably is not possible.

Preferably, winding device 500 is alternatively or additionally characterized in that on the movable subframe 502, a subsystem 507; 508; 509 of guidance system 504 is mounted so as to be movable jointly with subframe 502, and in that the subsystem 507; 508; 509 has at least one inlet 513 for at least one webbing-up means and/or at least one outlet 514 for at least one webbing-up means. An inlet 513; 531 for at least one webbing-up means is understood, in particular, as an opening in the subsystem 507; 508; 509 and/or in the guidance section 507 in question through which the webbing-up means enters the subsystem 507; 508; 509 and/or the guidance section 507; 517 in question as the webbing-up means is moved along its webbing-up path into winding device 500. An outlet 514; 529 for at least one webbing-up means is understood, in particular, as an opening in the subsystem 504; 506; 508; 509 and/or the guidance section 507 in question, through which the webbing-up means leaves the subsystem 507; 508; 509 and/or the guidance section 507 in question as the webbing-up means is moved along its webbing-up path into winding device 500. Each inlet 513; 531 and/or outlet 514; 529 is preferably assigned an appropriately oriented and/or configured counterpart of the guidance section 506; 507; 517 opposite it, in the web advancing position. For example, the subsystem and/or the at least one second guidance section 507 has one inlet 513 and two outlets 514, along with one diverter 508. The first guidance section 506 has one outlet 529, for example. Each third guidance section 517 has one inlet 531, for example, wherein at least one third guidance section 517 is preferably provided, and more preferably at least two third guidance sections 517 are provided.

Preferably, winding device 500 is alternatively or additionally characterized in that at least one diverter 508 of guidance system 504, by means of which a webbing-up path can be divided into different webbing-up paths, is mounted on the at least one subframe 502, and/or in that at least one intersection 509 of guidance system 504, where different webbing-up paths of guidance system 504 intersect, is located on the at least one subframe 502. This at least one diverter 508 is preferably movable jointly with the subframe 502 as an integral unit. This enables different webbing-up paths, and thus different web transport paths, to be realized. More particularly, together with appropriately configured second and third guidance sections 507; 517, this enables the optional winding of material web 02 in different directions, i.e. in particular the free selection of whether a surface of material web 02 that faces upward upon entering winding device 500 will face inward or outward on the wound-up material roll 511. The closer the diverter is located to winding position 528, the less guidance path needs to be doubled. An intersection of guidance system 04, in particular in the region of the second guidance section 507, enables, in particular, an optimally space-saving configuration of guidance system 04, in particular of the second guidance section, and the use of only one throw-on roller 503, while the wrap ratios of material web 02 around throw-on roller 503 and around the other web lead elements located in this area, in particular the other web lead elements that are located in the region of the second guiding section 507 and/or are movable jointly with the at least one subframe 502, nevertheless remain optimal.

Preferably, winding device 500 is alternatively or additionally characterized in that the at least one subframe 502 is disposed such that it is movable linearly relative to the at least one first frame 501. This enables a very simple construction and a reliable reproducibility of the positions of the second guidance section 507 relative to the first guidance section 506 and/or the third guidance section 517. More preferably, the at least one subframe 502 is disposed movably relative to the at least one first frame 501 by at least 10 cm, more preferably at least 20 cm, even more preferably at least 50 cm, and more preferably still at least 75 cm, and/or the at least one second guidance section 507 is disposed movably relative to the at least one first guidance section 506 and/or relative to the at least one third guidance section 517 by at least 10 cm, more preferably at least 20 cm, even more preferably at least 50 cm, and more preferably still at least 75 cm. The greater the mobility of subframe 502 and/or of the second guidance section 507, the greater the range of motion of throw-on element 503. Greater diameters of the material rolls 511 to be wound can therefore be realized.

Preferably, winding device 500 is alternatively or additionally characterized in that, when the second guidance section 507 is in its web advancing position, every projection of the at least one second guidance section 507 that extends at least 15 cm and at most 20 cm, more preferably at least 45 cm and at most 50 cm, and even more preferably at least 70 cm and at most 75 cm is free in adjustment direction B of any overlap with any component of the first guidance section 506, and/or in that when the second guidance section 507 is in its web advancing position, every projection of the at least one second guidance section 507 that extends at least 15 cm and at most 20 cm, more preferably at least 45 cm and at most 50 cm, and even more preferably at least 70 cm and at most 75 cm is free in adjustment direction B of any overlap with any component of the third guidance section 517.

Winding device 500 is alternatively or additionally characterized, for example, in that adjustment direction B has at least one component that is oriented orthogonally to a webbing-up direction of a webbing-up path of the webbing-up means at the transition point between first guidance section 506 and second guidance section 507. This means that these two guidance sections 506; 507 are moved in a different direction relative to one another from the direction in which the webbing-up means is passed between them. For example, adjustment direction B is itself oriented orthogonally to the webbing-up direction of the webbing-up path of the webbing-up means at the transition point between the first guidance section 506 and the second guidance section 507. Winding device 500 is alternatively or additionally characterized, for example, in that adjustment direction B has at least one component that is oriented orthogonally to a webbing-up direction of a webbing-up path of the webbing-up means at the transition point between the second guidance section 507 and the third guidance section 517. This means that these two guidance sections 507; 517 are moved in a different direction relative to one another from the direction in which the webbing-up means is passed between them. For example, adjustment direction B is itself oriented orthogonally to the webbing-up direction of the webbing-up path of the webbing-up means at the transition point between the second guidance section 507 and the third guidance section 517. Other relative angles between 0° and 90° are also possible.

A method preferably results for threading the at least one material web 02 into the at least one winding device 500, in particular processing machine 01, wherein the webbing-up means is moved along the at least one first guidance section 506, thereby moving material web 02, and wherein the webbing-up means is guided at an inlet 513 into the second guidance section 507, and after at least partially passing through the second guidance section 507 is halted. The webbing-up means then preferably enters the third guidance section 517. Material web 02 is then preferably separated from the webbing-up means and attached to a core and/or a material roll 511. Subsequently, the webbing-up means is preferably guided back to the first guidance section 506, in particular such that the webbing-up means leaves the second guidance section 507. The second guidance section 507 is then preferably moved relative to the first guidance section 506, in particular in adjustment direction B, and jointly with this movement, at least one throw-on element 503 is preferably moved up to a material roll 511 of winding device 500 and said material web 02 is at least subsequently wound onto said material roll 511. During the winding of material web 02 onto said material roll 511, the at least one throw-on element 503 is preferably moved progressively further away from the rotational axis 521 of material roll 511, in particular opposite the adjustment direction B, thereby moving at least the at least one second guidance section 507.

While preferred embodiments of a winding device for web-shaped material and a method for drawing at least one material web into at least one winding device, in accordance with the present invention, have been set forth fully and completely hereinabove, it will be apparent to one of skill in the art that various changes could be made, without departing from the true spirit and scope of the present invention, which is accordingly to be limited only by the appended claims.

The invention claimed is:

1. A winding device for a web-type material, the winding device comprising;

at least one first frame;

at least one first roll holding device in the at least one first frame, the at least one first roll holding device having at least one first roll holding means, the at least one first roll holding means being rotatable about a first rotational axis;

at least one throw-on element in the winding device, the at least one throw-on element being movably disposed relative to the at least one first frame in, and opposite to, at least one adjustment direction, which at least one adjustment direction has at least one component that points toward the first rotational axis;

a guidance system in the winding device and defining a webbing-up path for webbing up at least one material web, the guidance system having a first guidance section which is disposed fixedly relative to the at least one first frame and having at least a second guidance section and a third guidance section, at least two of the guidance sections being movable relative to one another; and wherein, in any position of the at least one throw-on element, at least one straight line between a point on the at least one throw-on element and the first rotational axis intersects the second guidance section of the guidance system.

2. The winding device according to claim 1, wherein the at least one second guidance section is disposed movably relative to the at least one first guidance section between at least one web advancing position and at least one offset position, and one of when the at least one second guidance section is in the at least one offset position, the webbing-up path defined by the guidance system is interrupted, and when the at least one second guidance section is in its at least one offset position, an end of the first guidance section and a beginning of the at least one second guidance section are spaced at least 20 cm further from one another than when the second guidance section is in its web advancing position.

3. The winding device according to claim 1, wherein, by the guidance sections of the guidance system, the webbing-up path one of can be and is defined.

4. The winding device according to claim 1, wherein the winding device has at least one subframe that is disposed movably relative to the at least one first frame, and wherein at least one throw-on element and the at least one second guidance section is mounted on the at least one subframe.

5. The winding device according to claim 4, one of wherein, on the at least one movable subframe, a subsystem of the guidance system is mounted movable jointly with the at least one movable subframe, and wherein the subsystem has one of at least one inlet for the webbing-up path and at least one outlet for the webbing-up path, and wherein, the at least one of the throw-on element and the at least one second guidance section is mounted on the at least one subframe so as to be movable jointly with the at least one subframe.

6. The winding device according to claim 4, one of wherein at least one diverter of the guidance system, by the use of which at least one diverter a webbing-up path of the guidance system can be divided into different webbing-up paths, is one of mounted on the at least one subframe, and wherein at least one intersection of the guidance system, where different webbing-up paths of the guidance system intersect, is located on the at least one subframe.

7. The winding device according to claim 1, wherein, regardless of the position of the at least one throw-on element and regardless of the position of the first rotational axis relative to the first frame, at least one rectilinear connection between the at least one throw-on element and the first rotational axis always intersects the second guidance section of the guidance system.

8. The winding device according to claim 1, wherein a winding position is a position in which one of the roll holding means and a core and a material roll is disposed, when material is to be wound onto said one of said core and material roll, and wherein, an access position is a position in which a machine operator is able to access one of the material roll that one of will be wound and has already been wound, and to the core thereof, and wherein the access position is a different position from the winding position.

9. The winding device according to claim 8, wherein the winding position is located between the access position and the at least one throw-on element, with respect to a longitudinal direction of the winding device.

10. The winding device according to claim 1, wherein one of the at least one first roll holding means and any one of cores and material rolls attached thereto are disposed movably between a winding position and an access position, and wherein the at least one roll holding means and any ones of cores and material rolls attached thereto are disposed pivotably between a winding position and an access position.

11. The winding device according to claim 1, wherein the at least one throw-on element is embodied as at least one of the throw-on element that is rotatable about at least one second rotational axis and as at least one throw-on roller, and wherein the one of the first rotational axis and the second rotational axis are each one of a rotational axis in a mathematical sense and a straight line extending to infinity.

12. The winding device according to claim 1, one of wherein the winding device is embodied as a turret winder, and the winding device has at least two roll holding devices.

13. A processing machine including the at least one winding device of claim 1, and wherein the processing machine is one of a printing machine and a coating machine and a laminating machine and a punching machine and an embossing machine and a folding machine.

* * * * *